US009103344B2

(12) United States Patent
Andresen

(10) Patent No.: US 9,103,344 B2
(45) Date of Patent: Aug. 11, 2015

(54) SUBMERSIBLE PUMP ASSEMBLY

(75) Inventor: Jens Andresen, Silkeborg (DK)

(73) Assignee: Grundfos Management a/s, Bjerringbro (DK)

( * ) Notice: Subject to any disclaimer, the term of this patent is extended or adjusted under 35 U.S.C. 154(b) by 317 days.

(21) Appl. No.: 13/499,949

(22) PCT Filed: Sep. 2, 2010

(86) PCT No.: PCT/EP2010/005389

§ 371 (c)(1),
(2), (4) Date: Jun. 1, 2012

(87) PCT Pub. No.: WO2011/042096

PCT Pub. Date: Apr. 14, 2011

(65) Prior Publication Data

US 2012/0230852 A1 Sep. 13, 2012

(30) Foreign Application Priority Data

Oct. 5, 2009 (EP) ..... 09012552

(51) Int. Cl.

| | |
|---|---|
| ***F04B 17/03*** | (2006.01) |
| ***F04D 13/08*** | (2006.01) |
| ***F04D 15/00*** | (2006.01) |
| ***F04D 15/02*** | (2006.01) |

(52) U.S. Cl.

CPC ..... *F04D 13/08* (2013.01); *F04D 15/0088* (2013.01); *F04D 15/0218* (2013.01); *F05B 2260/80* (2013.01)

(58) Field of Classification Search

CPC . F04D 13/08; F04D 15/0088; F04D 15/0218; F05B 2260/80

USPC ..... 417/63, 386, 390, 423.3, 401, 555.2

See application file for complete search history.

(56) References Cited

U.S. PATENT DOCUMENTS

| | | | | |
|---|---|---|---|---|
| 4,284,943 | A * | 8/1981 | Rowe | 318/806 |
| 4,456,432 | A * | 6/1984 | Mannino | 417/2 |
| 6,139,281 | A | 10/2000 | Schooler | |
| 6,167,965 | B1 * | 1/2001 | Bearden et al. | 166/250.15 |
| 6,481,973 | B1 * | 11/2002 | Struthers | 417/36 |
| 6,587,037 | B1 | 7/2003 | Besser et al. | |
| 8,579,600 | B2 * | 11/2013 | Vijayakumar | 417/234 |
| 2005/0110655 | A1 | 5/2005 | Layton | |
| 2009/0000789 | A1 * | 1/2009 | Leuthen et al. | 166/369 |
| 2009/0250210 | A1 * | 10/2009 | Allen et al. | 166/250.15 |

OTHER PUBLICATIONS

Int'l Search Report issued Nov. 3, 2010 in Int'l Application No. PCT/EP2010/005389.

* cited by examiner

*Primary Examiner* — Peter J Bertheaud
*Assistant Examiner* — Dominick L Plakkoottam
(74) *Attorney, Agent, or Firm* — Panitch Schwarze Belisario & Nadel LLP

(57) ABSTRACT

An immersion pump assembly includes an electric drive motor and a control device (14) for controlling the drive motor, which are configured for dipping into a liquid (18) to be conveyed. An external display device (26) and/or an external communications device are/is configured for arrangement outside the liquid (18) to be conveyed and are/is connected to the control device (14) for signal transmission.

8 Claims, 6 Drawing Sheets

Prior Art

SUBMERSIBLE PUMP ASSEMBLY

CROSS-REFERENCE TO RELATED APPLICATIONS

This application is a Section 371 of International Application No. PCT/EP2010/005389, filed Sep. 2, 2010, which was published in the German language on Apr. 14, 2011, under International Publication No. WO 2011/042096 A1 and the disclosure of which is incorporated herein by reference.

BACKGROUND OF THE INVENTION

The present invention relates generally to a submersible pump assembly with an electrical drive motor.

Basically, two types of submersible pump assemblies are known from the state of the art. There are submersible pump assemblies with an electrical drive motor, which includes an electronic control or regulation device for the operation of the electrical drive motor. The device being arranged directly on the submersible electrical drive motor. These submersible pump assemblies merely require an electrical mains connection lead which leads into the pump sump. However, they provide no external control or monitoring possibilities at all.

Moreover, submersible pump assemblies are known, which include an external control and regulation device which is arranged outside the pump sump and which is connected via an electrical connection lead to the submerged drive motor in the pump sump. In the case that sensors such as for example level sensors in the pump sump are yet necessary for the operation of this submersible pump assembly, these sensors must likewise be connected via electrical leads to the control or regulation device outside the pump sump, so that numerous lead connections are necessary.

A submersible pump assembly is shown in FIG. 1, which once again explains the state of the art. In the state of the art, it is known to arrange a submersible pump 4, consisting of a drive motor and the actual pump, in a pump sump 2. The submersible pump 4 is connected via a lead 8 to an external control device 6 which is arranged outside the pump sump 2. The lead 8 serves for the energy supply of the submersible pump 4 or of its drive motor. The switching of the submersible pump 4 on and off is thereby effected via the control device 6. The control device 6 may furthermore for example also yet contain a frequency converter for activating the drive motor of the submersible pump 4. Moreover, the control device 6 is connected via leads 12 to sensors 10 in the pump sump 2. The sensors 10 may for example be pressure sensors, level switches, temperature sensors etc. The control device 6 controls the submersible pump 4 in dependence on the output signals of the sensors 10, in particular the control device 6 switches the submersible pump 4 on and off in dependence on the signals. It is to be understood that here several leads 8 and 12 need to be led out of the pump sump to the control device 6.

BRIEF SUMMARY OF THE INVENTION

With regard to this state of the art, it is an objective of a preferred embodiment of the present invention to provide a simplified submersible pump assembly which may be connected with few lead connections and moreover provides the possibility of monitoring the operation of the submersible pump assembly at ground level, for example outside the pump sump or borehole, into which the drive motor is submerged.

The above objective is achieved by a submersible pump assembly with an electric drive motor and with a control device for the control of the drive motor, which are designed for submerging into a fluid to be delivered, wherein an external display device and/or an external communication device are designed for arrangement outside of the fluid (to be delivered and are connected to the control device for signal transmission. Preferred embodiments are to be deduced from the subsequent description as well as the attached drawings.

The submersible pump assembly according to a preferred embodiment of the present invention includes an electrical drive motor and a control device for regulating or controlling the drive motor. The drive motor as well as this control device is designed for submersion into a fluid to be delivered. The control device is preferably arranged directly on the drive motor or is integrated with this into a motor housing or pump housing.

According to a preferred embodiment of the present invention, moreover an external display device and/or an external communication device is provided, which is designed for the arrangement at ground level, for example outside the fluid to be delivered. The display device may for example comprise control lamps or a display, via which operating conditions and in particular errors of the submersible pump assembly may be signalised. An external communication device may for example serve for connecting sensors arranged outside the fluid to be delivered or however for connecting the submersible pump assembly to further monitoring or control systems, in order for example to be able to transmit error messages to central monitoring systems. The external display device or the external communication device which may also be designed as an integrated device, are connected to the control lead for signal transmission, in particular via a lead. This means that according to a preferred embodiment of the present invention, the control lead which controls or regulates the drive motor of the submersible pump, is arranged directly on the drive motor and together with the pump and the drive motor submerges into the fluid to be delivered. In this manner, a wiring effort between an external control device or regulation device and the drive motor is done away with, and a simple mains connection lead leading to the outside is sufficient instead. However, despite this, in order to permit a communication to the outside, in particular a display of errors outside the fluid to be delivered, this submerged control device, for signal transmission, is connected to a display device or communication device, which is to be arranged outside the fluid to be delivered.

Preferably, at least one sensor connected to the control device is present. This sensor is preferably likewise submerged into the fluid to be delivered and further preferably likewise integrated into the submersible part of the submersible pump assembly, for example the part formed by the submersible pump, drive motor and control device. Such a sensor may for example be a level switch which is used in order to switch the pump on and/or off in dependence on the fluid level. By way of the arrangement of the control device and of the sensor in the fluid to be delivered, the effort required for connecting these elements to one another is significantly reduced, since no lead is necessary from the submerged sensor to a control or regulation device arranged outside the fluid.

It is preferable for the control device to be designed in a manner such that the control device controls the drive motor on the basis of an output signal of the at least one sensor. The sensor as described may for example be a level switch or float switch which delivers a signal representing the fluid level to the control device and, depending on which, the control device switches the drive motor on and/or off.

The display device preferably comprise at least one signal device, in particular a signal lamp. Such a signal device, such as also an acoustic signal device for example, may be used to signal errors of the pump assembly outside the fluid to be delivered, at ground level. Thus for example, a signal lamp may light up if the submersible pump assembly does not operate or not as envisaged, for example if the drive motor fails or the impeller of the pump blocks.

The external display device and/or the external communication device are connected to the control device, preferably via an electric cable. This electric cable may be a cable purely for signal transmission, so that this may also be designed as a low-voltage cable. Inasmuch as this is concerned, it is possible to design such an electrical cable so that no particularly high demands are placed on the electronic safety. The electrical energy supply for the operation of the drive motor may be effected via a separate mains cable.

Even if the electrical cable is not a mains cable, it is preferably for the control device as well as the display device and/or the communication device to be designed in a manner such that a data transmission in the manner of a data transmission via powerline-communication is effected via the electrical cable between the control device and the external display device and/or external communication device. Thus, a data transmission signal may be modulated on a carrier signal, in order to transmit different data or information for the electrical cable, without this electrical cable having to have numerous electrical leads. A simple data communication may therefore be achieved. Since this data transfer is effected independently of the mains connection lead of the drive motor, disturbances in the electrical mains caused by the data transmission may be avoided. Inasmuch as this is concerned, one may do away with complicated additional circuiting for preventing disturbances in the electricity mains.

According to a further preferred embodiment of the present invention, the control device includes at least one electrical or electronic switch for switching the display device on and off. As cited, the display device in the simplest case may be a signal lamp for example, which is switched on and off via such a switch by the control device which with the pump and the drive motor is submerged into the fluid to be delivered.

According to a further preferred embodiment of the present invention, the control device and the communication device are designed in a manner such that a data transmission between the control device and the communication device and/or vice versa is effected via an electrical cable which likewise connects the control device to the display device. Thus, for example with the use of a signal lamp, the two electrical leads which connect the signal lamp to the control device and to a switch arranged in this, additionally to the electrical energy for operating the signal lamp, are used in order to transmit data to the communication device or from the communication device to the control device via these leads. Thus, a data transmission signal may be modulated on a carrier signal which is formed by the operating voltage for the signal lamp.

According to a further preferred embodiment of the present invention, the communication device and/or the display device are designed for the connection to several control devices of several submersible pump assemblies. Thus, a central monitoring of several submersible pump assemblies is possible with the help of a single display device and/or communication device. Each of the submersible pump assemblies however has its own control device arranged in the drive motor and this control device controls the operation of the drive motor. Thereby, a communication of the individual control devices amongst one another is possible via the common communication device, so that a networked operation of several submersible pump assemblies is possible, for example in order to connect or disconnect the submersible pumps depending on the requirements.

Preferably, the submersible pump assembly is designed independently of external control devices and/or sensor devices, for autonomous operation. For example, necessary sensors are preferably integrated directly into the control device or however are likewise arranged directly on the submersible part of the submersible pump assembly, i.e. preferably directly on the drive motor. These in particular are the level switch for switching the submersible pump assembly on and off, for example in the form of pressure sensors. Moreover, no external control device, in particular no external control device which needs to be arranged on ground level outside the fluid to be delivered, is provided. Thus, the submersible pump assembly may be taken into operation as soon as it is submerged into the fluid to be delivered, wherein only a mains connection lead is to be led out of the fluid to be delivered. Then it is only a communication device or display device which is yet to be arranged outside the fluid to be delivered.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Certain terminology is used in the following description for convenience only and is not limiting. Unless specifically set forth herein, the terms "a," "an" and "the" are not limited to one element, but instead should be read as meaning "at least one." The terminology includes the words noted above, derivatives thereof and words of similar import.

Figure 1:
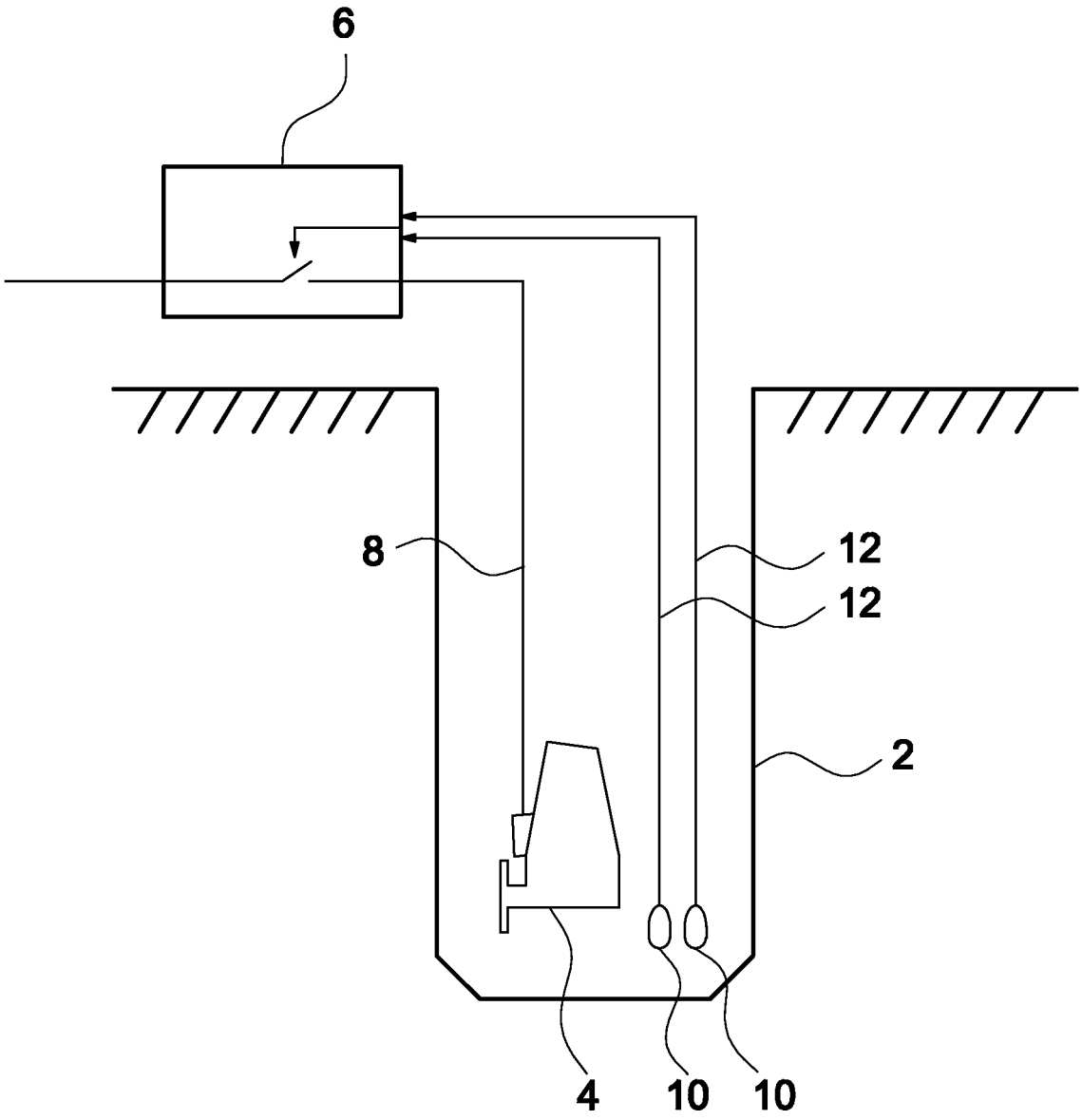
FIG. 1 is a schematic view of a submersible pump assembly according to the prior art.
Figure 2:
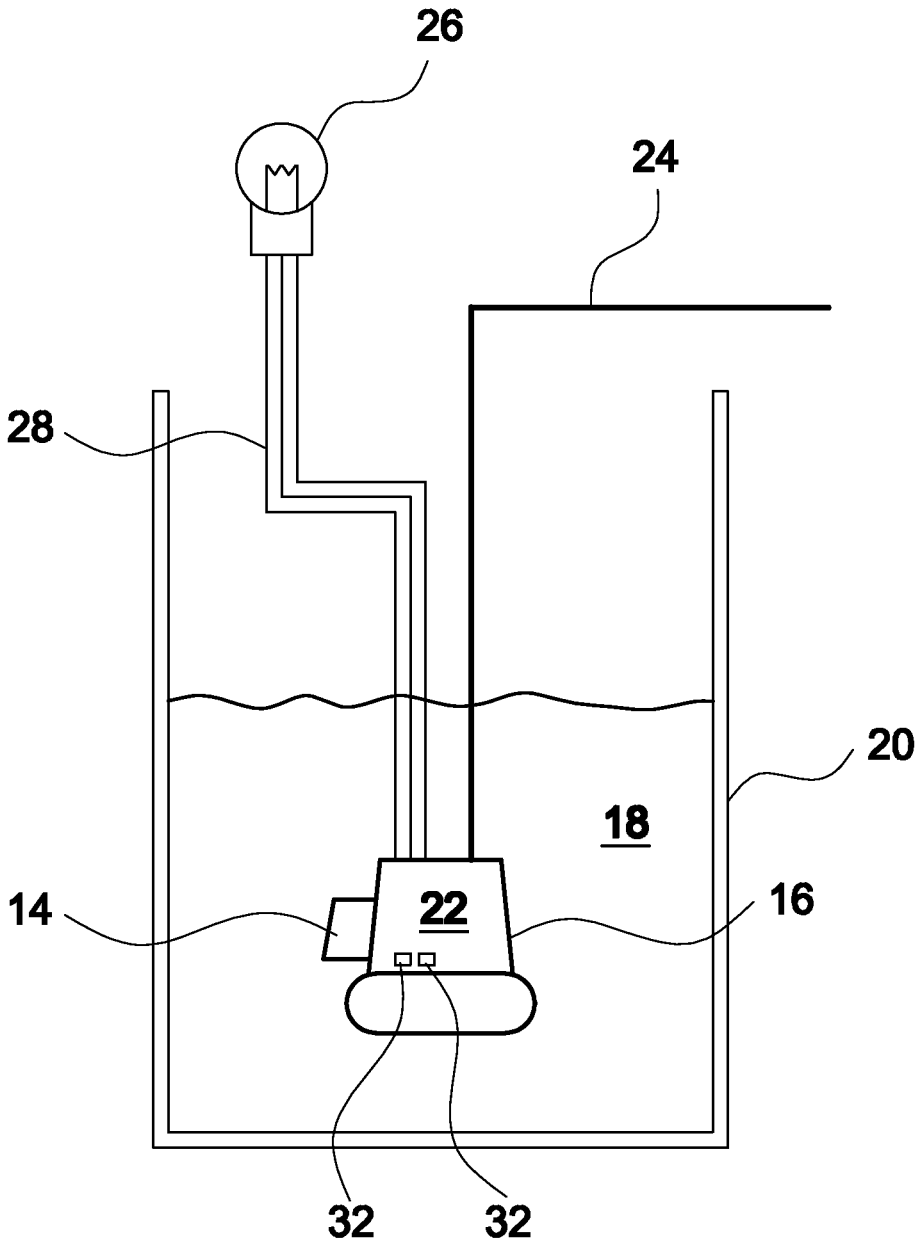
FIG. 2 is a schematic view of a submersible pump assembly according to a first preferred embodiment of the present invention.

Referring to the drawings in detail, wherein like numerals indicate like elements throughout the several views, FIG. 2 shows a first preferred embodiment of the present invention. A control device 14 is arranged directly on a submersible pump 16 and submerges with this into a fluid 18 to be delivered, in a pump sump 20. The control device 14 may thereby be applied directly onto a motor housing 22 of the submersible pump 16 or may be also integrated into this. The control device 14 controls the operation of the drive motor in the inside of the motor housing 22 and then autonomously in the submersible pump 16, without an external control device arranged outside the pump sump 20 becoming necessary. In particular sensors, for example pressure sensors, temperature sensors or level sensors, which are arranged in the pump sump 20, may be connected to the control device 14. Also such sensors can be arranged directly on or in the submersible pump 16. Since no further signals, switch impulses or likewise need to be transmitted via the mains connection lead 24, disturbing influences on the electricity mains are avoided.

In the preferred embodiment example according to FIG. 2, moreover a signal lamp 26 is provided which is arranged outside the pump sump 20 and forms a display device. This display device or signal lamp 26 may indicate the operating condition of the submersible pump 16 outside the pump sump, for example light up when the pump is in operation, or however may light up or light up in a different color for example, in order to signalise an error of the submersible pump 16, for example a blocking of the impeller. For this, the signal lamp 26 is activated and in particular switched on and off, by the control device 14. For this, the signal lamp 26 is connected via an electrical cable 28 which here is represented as a three-core cable.

Figure 3:
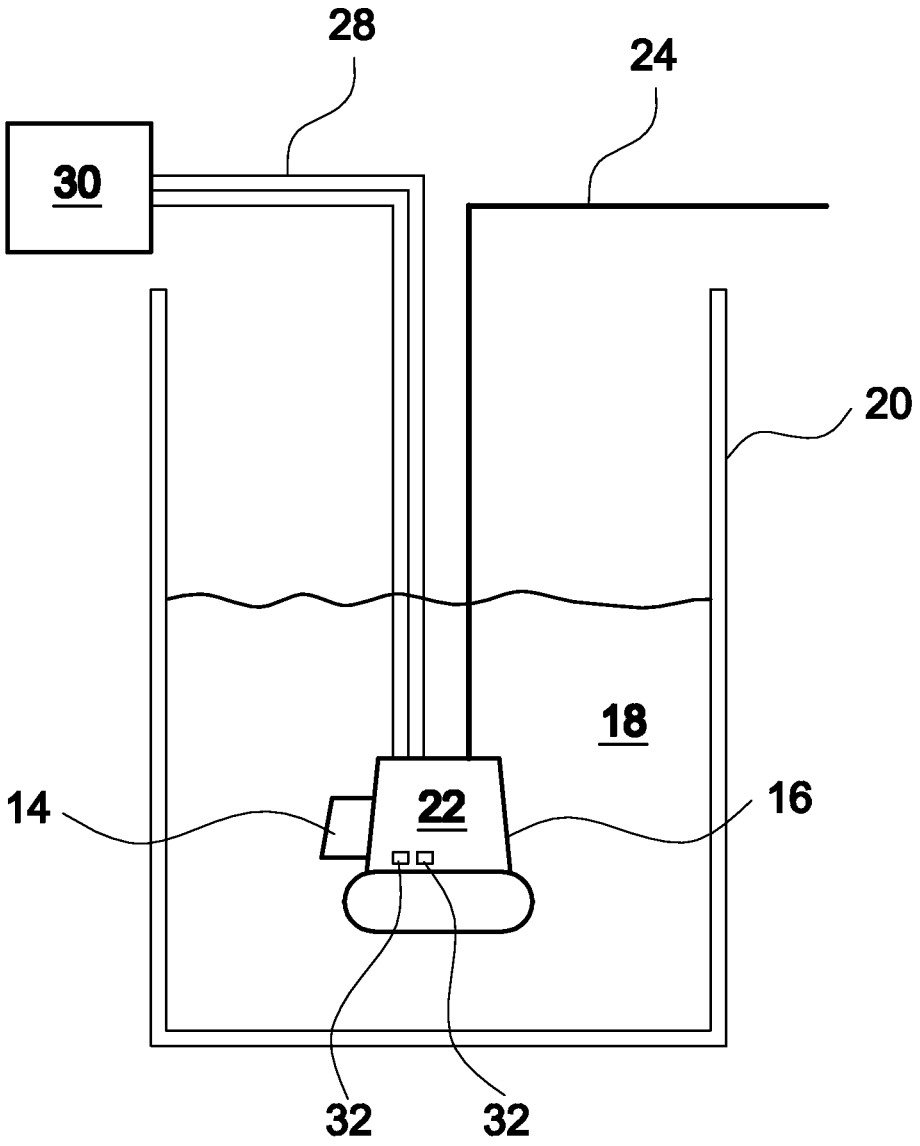
FIG. 3 is a schematic view of a submersible pump assembly according to a second preferred embodiment of the present invention.

A similar alternative preferred embodiment is shown in FIG. 3. This preferred embodiment corresponds to the design according to FIG. 2, with the difference that instead of a signal lamp 26, a communication device 30 is connected to the control device 14 via an electrical cable 28. With this preferred embodiment too, the submersible pump 16 is controlled or regulated autonomously by the control device 14, wherein the control device 14 as the case may be processes signals of sensors and controls the submersible pump 16 in dependence of these signals. The sensors may for example detect the temperature, fluid level and/or pressure and are preferably likewise integrated into the submersible pump 16 or arranged directly on this. Signals or display devices, for example also a signal lamp according to the preferred embodiment example in FIG. 2, may be connected to the communication device 30. Moreover, the communication device 30 may form an interface to external monitoring systems or control systems, for example a central building control or likewise. The data transmission between the control device 14 and the communication device 30 via the electrical cable 28 is preferably effected as is described further below, in the manner of a data transmission via powerline-communication and thereby a data transmission signal is modulated on a carrier signal.

Figure 4:
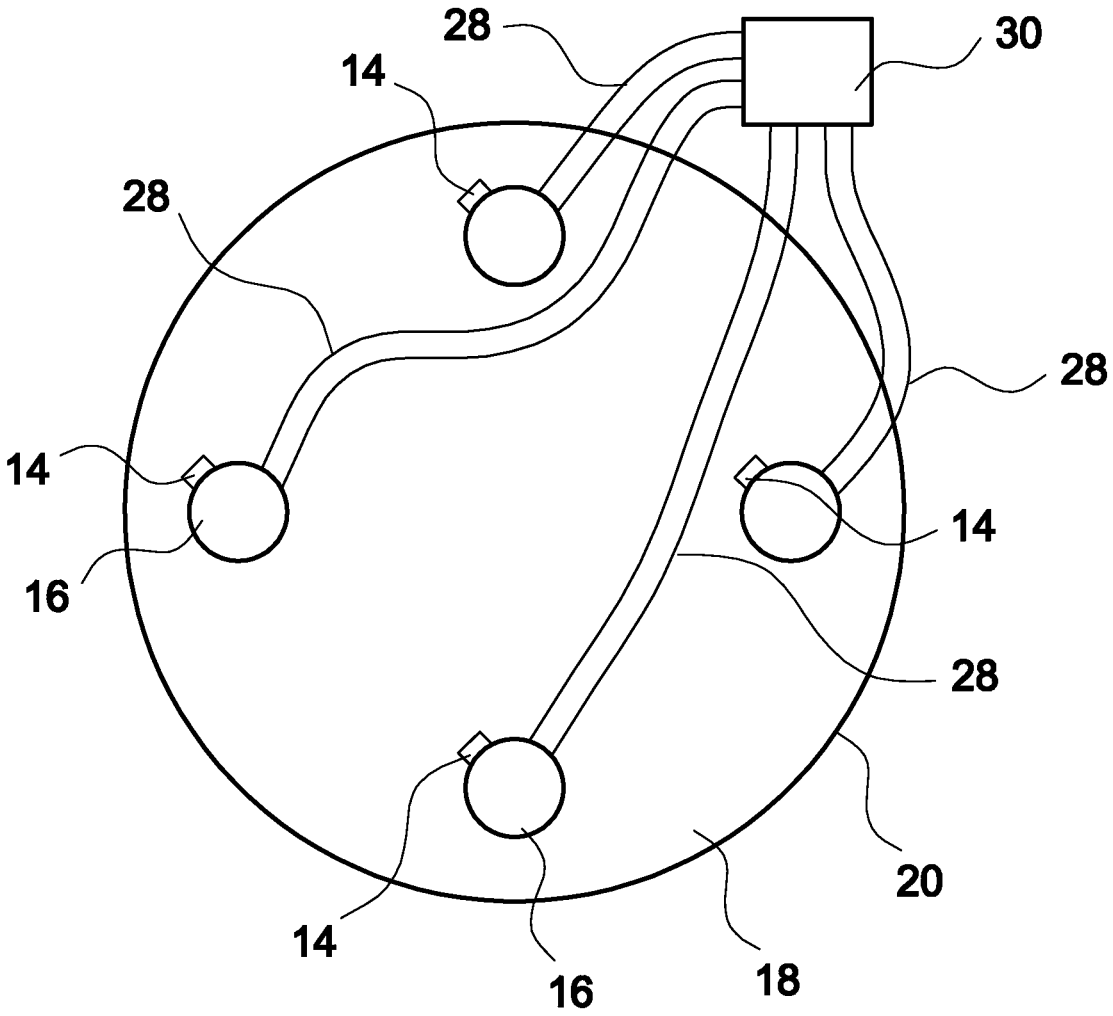
FIG. 4 is a schematic view of an arrangement of several submersible pump assemblies according to the present invention, with a common communication lead.

In the examples according to FIGS. 2 and 3, in each case a signal lamp 26 or a communication device 30 was assigned to a submersible pump 16. However, as is shown in FIG. 4, it is also possible so connect several submersible pumps 16 to a common communication device 30 via electrical cables 28. Thereby, it is to be understood that as is described by way of FIGS. 2 and 3, the individual submersible pumps 16 are autonomously operated or controlled via an associated control device 14. The communication device 30 which is connected via electrical cables 28 to the individual submersible pumps 16, preferably only serves for the communication of the control devices 14 to the outside, for example with display devices or house automation systems, in order there to display the operating conditions of the individual submersible pumps 16.

Figure 5:
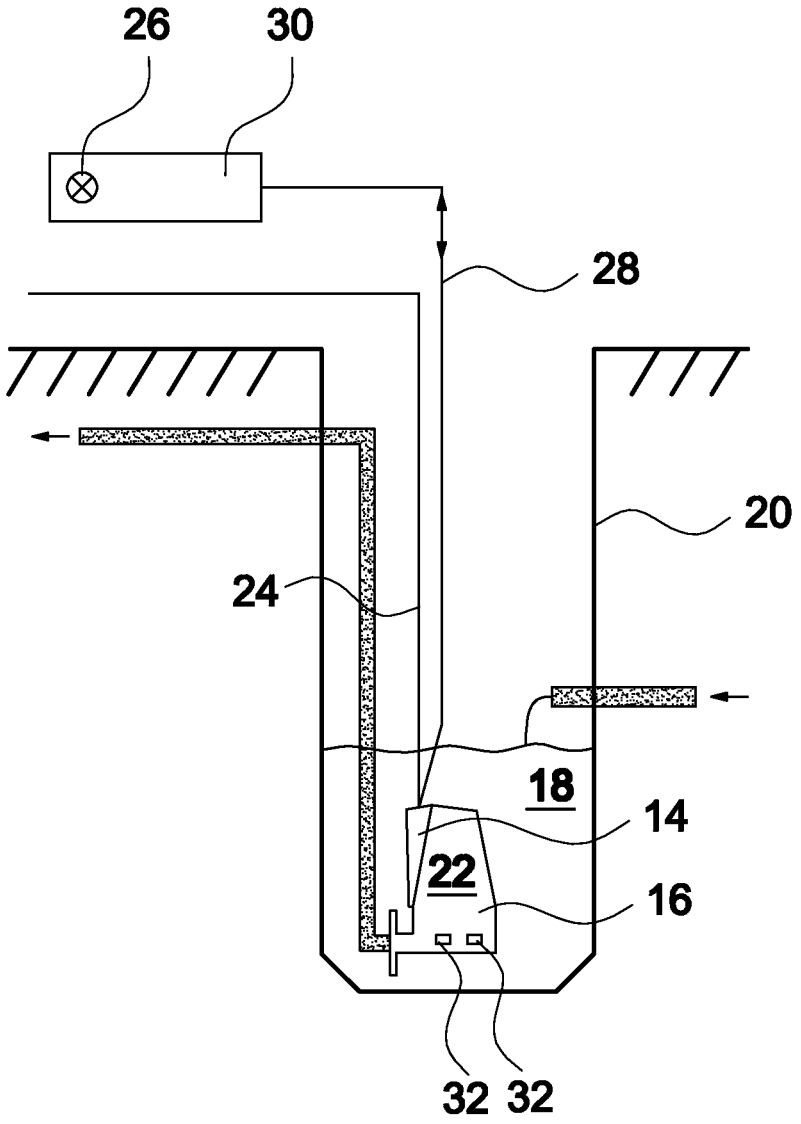
FIG. 5 is a schematic view of a submersible pump assembly according to a further preferred embodiment of the present invention.
Figure 6:
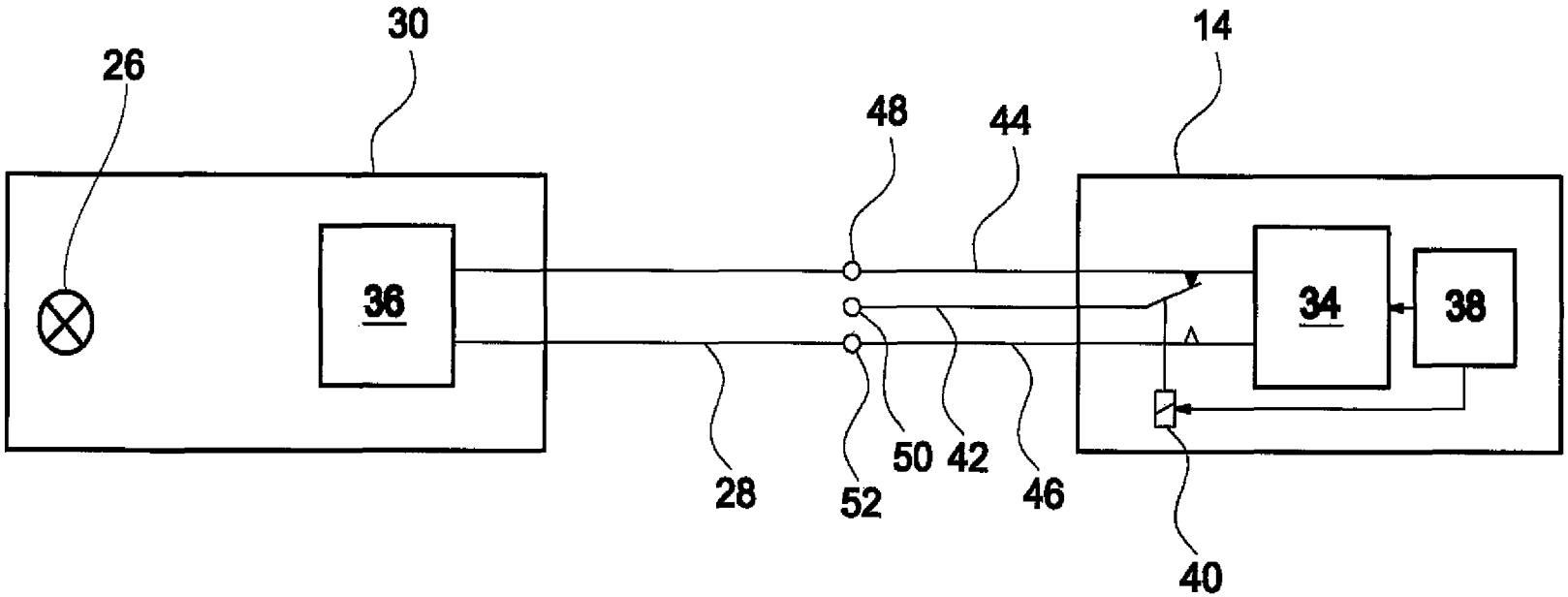
FIG. 6 is a schematic view of a data transmission device for a submersible pump assembly according to the present invention.

A further preferred embodiment of the present invention is described by way of FIGS. 5 and 6, with which the use of a communication device 30 is combined with at least one signal lamp 26. With this preferred embodiment example, the signal lamp 26 is switched on and off by the control device 14 via an electrical switch, for example a relay. The electrical leads in the electrical cable 28 thereby serve for the direct voltage supply for the signal lamp 26. Simultaneously, a powerline-communication of the control device 14 and the communication device 30 is effected simultaneously via these electric leads. Thus, for example, the operating voltage for the signal lamp 26 may be used as a carrier signal and a data transmission signal may then be modulated on this carrier signal. In this manner, one may realise varied tasks via very few connection leads which lead to the outside out of the pump sump 20. The control of the submersible pump 16 is effected autonomously via the control device 14 which is arranged directly on the submersible pump 16 and this likewise is submerged into the fluid 18. This control device is likewise connected to sensors 32 integrated into the submersible pump 16, and the control device 14 controls the drive motor of the submersible pump 16 on the basis of the output signals of these sensors. This corresponds to the embodiment examples according to FIGS. 2 and 3.

Communication modules 34, 36 are arranged in the control device 14 and the communication device 30, for the data transmission by way of powerline-communication. The communication module 34 of the control device 14 is activated by the actual control module 38 which controls the operation of the submersible pump 16, in order to send data to the communication module 36 in the communication device 30 via the electrical cable 28. Moreover, an electric switch in the form of a relay 40 is in the control device 14 and may selectively bring a third electrical lead 42 in the electrical cable 28 in contact with the first electrical lead 44 or the second electric lead 46. A signal lamp 26 may either be connected between the connections 48, 50 or 50, 52 of the electric cable 28, depending on which operating condition is to be displayed. Alternatively, it is also possible to provided two signal lamps, one between the electrical connections 48, 50 and one between the electric connections 50, 52. In this manner, the communication device 30 may be connected to the control device 14 in a very simple manner as a display device in the form of a signal lamp 26 for example, via one and the same connection cable 28. Thereby, it is advantageous that this data transfer is effected completely independently of the mains connection lead 24, so that no disturbances of the signal is effected in the electricity mains, Moreover, disturbances in the electricity mains may not compromise the communication via the electric cable 28.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A submersible pump assembly, comprising:

an electric drive motor;

a control device (14) that controls the electric drive motor, each of the electric drive motor and the control device being designed such that in use of the submersible pump assembly they are submerged in a fluid (18) to be delivered;

an external display device (26) or an external communication device (30), connected to the control device (14) for signal transmission, the external display device (26) and the external communication device (30) being disposed or arranged outside the fluid (18) to be delivered; and an electric cable (28), separate from a mains cable connected to the electric drive motor to supply electric energy to the electric drive motor, the electric cable having an electric cable connection, apart from a mains cable connection, which connects the external display device (26) or the external communication device (30) to the control device (14), wherein the control device (14) as well as the external display device (26) or the external communication device (30) each include a respective power-line communication module (34, 36), wherein data transfer between the power-line communication modules is effected via the electric cable (28) by powerline-communication.

2. A submersible pump assembly according to claim 1, wherein at least one sensor (32) is connected to the control device (14).

3. A submersible pump assembly according to claim 2, wherein the control device (14) controls the electric drive motor on a basis of an output signal of the at least one sensor (32).

4. A submersible pump assembly according to claim 1, wherein the external display device comprises at least one signal lamp (26).

5. A submersible pump assembly according to claim 1, wherein the external communication device (30) is connected to at least one signal lamp.

6. A submersible pump assembly according to claim 1, wherein the control device (14) includes at least one electrical or electronic switch (40) for switching the external display device (26) on and off.

7. A submersible pump assembly according to claim 1, wherein the external communication device (30) or the external display device (26) are designed for connection to several control devices (14) of several submersible pump assemblies (16).

8. A submersible pump assembly according to claim 1, wherein the submersible pump assembly (16) is designed for autonomous operation independently of external control devices or sensor devices.

* * * * *